United States Patent [19]

Baum

[11] 4,146,080

[45] * Mar. 27, 1979

[54] COMPOSITE MATERIALS CONTAINING REFRACTORY METALLIC CARBIDES AND METHOD OF FORMING THE SAME

[75] Inventor: Charles S. Baum, St. Clair Shores, Mich.

[73] Assignee: Permanence Corporation, Detroit, Mich.

[ * ] Notice: The portion of the term of this patent subsequent to May 24, 1994, has been disclaimed.

[21] Appl. No.: 799,374

[22] Filed: May 23, 1977

Related U.S. Application Data

[63] Continuation-in-part of Ser. No. 668,265, Mar. 18, 1976, Pat. No. 4,024,902, which is a continuation-in-part of Ser. No. 578,122, May 16, 1975, abandoned.

[51] Int. Cl.[2] ..... B22D 19/02

[52] U.S. Cl. ..... 164/97; 164/100; 75/123 CB; 75/123 K; 75/240

[58] Field of Search ..... 164/55, 57, 58, 97, 164/98, 100, 103, 106, 119, 120; 75/53; 148/34; 75/240, 123 CB, 123 K; 428/627, 558, 565

[56] References Cited

U.S. PATENT DOCUMENTS

| | | | |
|---|---|---|---|
| 3,149,411 | 9/1964 | Smiley et al. | 75/203 X |
| 3,175,260 | 3/1965 | Bridwell et al. | 164/97 |
| 3,258,817 | 7/1966 | Smiley | 164/97 X |
| 3,941,181 | 3/1976 | Stoddy | 164/97 X |
| 4,024,902 | 5/1977 | Baum | 164/100 X |

*Primary Examiner*—Richard B. Lazarus
*Assistant Examiner*—Gus T. Hampilos
*Attorney, Agent, or Firm*—Krass & Young

[57] ABSTRACT

Composites consisting of refractory metallic carbide particles in a local matrix of an alloy having a lower melting point than the carbides are prepared by placing sections of refractory metallic carbide, at least some of which are larger in size than those desired in the final composite, in a mold. Matrixing alloy is heated above the melting temperature of the binder metal employed in the sintered carbide and then poured into the relatively cold mold. The binder metal dissolves at least at the outer surfaces of the sections and diffuses into the alloy which is allowed to naturally cool and solidify. The final composite contains micron size particles of the carbides released from the large sections when the binder melts.

9 Claims, 4 Drawing Figures

COMPOSITE MATERIALS CONTAINING REFRACTORY METALLIC CARBIDES AND METHOD OF FORMING THE SAME

REFERENCE TO RELATED APPLICATIONS

This application is a continuation-in-part of application Ser. No. 668,265, filed Mar. 18, 1976, now U.S. Pat. No. 4,024,902, which in turn was a continuation-in-part of application Ser. No. 578,122, filed May 16, 1975, and now abandoned.

BACKGROUND OF THE INVENTION

1. Field of the Invention

This invention relates to methods of forming articles consisting of particles of refractory metal carbide disposed in a metal matrix and to composite structures formed by this method.

2. Prior Art

The refractory metal carbides such as tungsten carbide, titanium carbide, tantalum carbide and the like are among the hardest man made materials and are logical choices for use as cutting tools, wear and abrasion resistant parts, etc. However, these materials are extremely brittle and will not withstand any appreciable impact forces. Accordingly, these metals have typically been used as constituents of composites in which microscopic particles of the carbides are supported in a more ductile metallic matrix. The most common method of achieving this composite form is by sintering micron size particles of refractory carbide and a powder metal binder from the cobalt, nickel, iron family. Such sintered or cemented carbides are commonly employed as cutting tools, wire drawing dies and the like. They are however relatively expensive compared with other industrial metals and too brittle for many applications where impact forces are exerted on the part.

In certain applications the high cost and brittle nature of the sintered carbides has been overcome by forming a composite consisting of sintered carbide particles or chunks supported in a matrix of a more resilient metal. The wear resistance of the sintered particles is complemented by the toughness of the matrix to form a material that is more abrasion resistant than the matrix material and can withstand impact loads better than the sintered carbide. The composites often make use of sintered carbide derived from worn cutting tools or scrap material produced during the sintering process.

Articles formed from these composite materials are used in applications where they are subjected to regular contact with hard, abrasive materials as conventional materials either wear too quickly or lack the impact resistance to withstand use over a long period. For example, they may be employed in ore treatment plants as chutes, or as facings on rock drills. They may also be employed in security applications such as for locks and safes because of their resistance to penetration by drills and like tools.

The failure mode of the composites in high abrasion typically involves the erosion of the matrix portion of a surface until a substantial portion of a sintered particle is exposed, and then either tearing away of that particle from the matrix or chipping off the exposed, brittle carbide particle. Efforts to improve the composite to minimize this failure mode have been directed toward use of harder matrix materials to minimize their erosion. But this usually increases the brittleness of the matrix making it easier for a particle to break away by cracking at the matrix-particle interface. In addition, the whole composite may become brittle as the matrix hardness is increased.

Previous efforts to form composite materials consisting of sintered metallic carbide particles in a soften metal matrix have been directed toward avoidance of any deterioration of the sintered material as a result of the heat of the molten matrix. Typically, copper based alloys have been employed for the matrix because of their low melting temperatures in the range of 1900° F. to 2100° F. In applications where a harder matrixing material is required, using metals with melting temperatures close to the temperature at which the metallic carbide binder melts, attempts have been made to very carefully control the temperature at which the composite is formed to minimize the amount of sintered material dissolved in the matrix. For example, U.S. Pat. Nos. 3,175,260 and 3,149,441 disclose methods wherein the steel matrix is heated to a temperature only sufficient to allow it to be poured over and infilitrate the tungsten carbide particles disposed in a mold. The particles are preheated to this infilitration temperature and the composite is maintained at this temperature for a sufficient time after pouring to insure thorough infiltation of the particle mass by the matrix material.

SUMMARY OF THE INVENTION

The present invention is directed toward a method of forming these composites which results in a substantially harder, stronger body than the prior art methods, and to articles formed by the method of the present invention. Unlike the prior art methods which attempt to avoid dissolution of the binder of the sintered metallic carbide components into the matrixing alloy, the present invention is directed toward materials having zones of alloy strengthened by the inclusion of the dissolved constituents of the sintered carbides. The present invention broadly contemplates the placement of sintered particles of a larger size than those desired in the finished article, in a mold in which the composite article is to be formed. A metal alloy is separately heated to a temperature of at least about 250° F. above the melting temperature of the matrix alloy and above the melting temperature of the binder metal of the sintered material. The molten alloy is then poured into the mold which is relatively cold; i.e., below the melting temperature of the alloy and of the binder.

As the molten alloy contacts the binder metal on the surface of the sintered carbide particles the binder metal melts and/or dissolves into the molten alloy freeing the metallic carbide particles from the surface of the larger sintered mass. Depending upon the temperature of the molten alloy these freed metallic carbide particles may have some tendency to dissolve in the molten alloy but this reaction will occur at a much lower rate than the melting or dissolving of the binder metal.

The metallic carbide particles will be wet by the molten alloy. Thus after freezing, there will be a metallurgical bond between the matrix and the metal carbide particles. Thus achieving by this process a solid mass which is unachievable by other infiltration processes except in a controlled atmosphere furnace or the like.

The fact that the molten alloy only contacts the metallic carbide particles at the surface of the larger sintered sections allows easy infiltration of the molten alloy through masses of these sintered particles and avoids clogging which occurs if the molten alloy is poured over a similar mass of unsintered, micron size metallic carbide particles.

To understand the mechanism of the present invention consider its use with metallic carbide particles having a cobalt binder, the most common type of binder.

Cobalt will dissolve in any molten iron alloy at about 2650° F. or higher. Accordingly, as long as the poured alloy has a temperature in excess of about 2650° F. when it has infiltrated the particles, the binder at the surface of the sintered particles dissolves in the steel and diffuses into the molten alloy. This dissolution continues until the matrix cools below 2650° F., or the cobalt binder is completely dissolved, leaving only the metallic carbide particles. To avoid such complete dissolution the present invention utilizes sintered particles having combinations of volume and surface area which prevent their complete dissolution before freezing of the matrix. These may involve use of at least some relatively large sintered particles in the mold which only partially dissolve before the matrix cools below 2650° F., or a relatively large quantity of smaller particles, or some combinations thereof. Some of the particles may completely dissolve before freezing. The size and placement of the particles must be balanced with the pour temperature of the matrix, the initial temperature of the mold, and the volume and surface area of the molt to insure that the heat of the matrix causes a dissolving action at the surface of the particles but at least some of the particles still exist, in reduced size, when the matrix freezes. The dissolving action reduces the size of these sintered tungsten carbide particles which remain after freezing and also surrounds the remaining particles with a strong but somewhat ductile shield, termed a "diffusion zone" which allows the particles to resist forces that would tend to tear them out of the matrix. This zone also forms a metallurgical bond between the remaining particles and the matrix.

The dissolving of the binder also leaves micron size metallic carbide particles in the diffusion zone. The density of these particles will depend upon the initial pouring temperature of the alloy, the initial temperature of the mold and the sintered particles, the relative volumes of the poured matrix and the sintered particles and the initial particle size.

The proportion of metallic carbide particles in the final composite may be increased, and the solubility of these particles controlled by the inclusion of some smaller sintered particles (fines) that completely degredate into metallic carbide particles by dissolution of the binder before the poured metal solidifies. When this binder (and carbide) goes into solution in the alloy it decreases the solubility of the alloy for the constituents of the remaining particles and cools the poured metal to limit the degree to which the remaining particles are degredated.

The resultant material has excellent wear resistant properties resulting from the hardness of the carbide particles and the tungsten steel matrix and from the ability of the diffusion zones to prevent dislodgement of the carbide particles from the matrix.

The articles formed in accordance with the present method may be classified in terms of the distribution of the sintered particles in the mold, and the finished composite, and the dimensions of the diffusion zones surrounding the particles. If the particles are relatively closely spaced to one another in the mold, and the temperature of the poured matrix is high so as to produce relatively large diffusion zones, the diffusion zones will merge to form a composite material characterized by the sintered particles in a matrix of material having the characteristics of the diffusion zones. Alternatively, if the particles are relatively widely spaced and the temperature of the poured metal is relatively low, so as to produce small diffusion zones, the composite will be characterized by "islands" of the sintered particles surrounded by their diffusion zones containing sintered and unsintered particles in a matrix having substantially the cast alloy.

Fine sintered metallic carbide particles or unsintered micron size particles may be added to either the molten matrix before pouring in the mold, to increase the density of the unsintered metallic carbide particles in the final material. While sintered fines or unsintered micron size particles which are added to the melt before pouring (either in the furnace or the ladle), will likely completely dissolve, they will reduce the solubility of the molten material for the molten constituents of the sintered carbide and will accordingly reduce the degree to which the particles in the mold will be reduced during the formation of the present material. Similarly, fine particles added to the mold, to the extent that they completely dissolve, will reduce the solubility of the melt for the slightly larger particles, increasing the density of the undegradated metallic carbide particles in the final material.

The density of the sintered particles in the mold before pouring, and hence the density of the unsintered particles in the final material, may be increased by use of the high density packing technique disclosed in my patent application Ser. No. 498,994 entitled "High Density Composite Structure of Hard Metallic Material in a Matrix and Method of Making the Same". Broadly, this technique involves the use of sintered particles of a first, relatively large size and other particles of a second, substantially smaller size. The mold is packed with the larger particles and then the interstices between the larger particles are filled with the smaller particles using vibrational techniques.

If the mold of the present invention is packed with sintered particles in this manner and fine particles of sintered carbide or of pure metallic carbide are mixed with the matrix before pouring, the final material which results contains a density of metallic carbide which equals the density of sintered carbides having high percentages of binder. Compared to such sintered carbide, the materials of the present invention are substantially lower in cost and are much tougher.

The economic advantage of the present material is enhanced when scrap carbides are used. Titanium carbide scrap is particularly low in cost because of the inability of more conventional matrixing techniques to wet the titanium particles. No difficulty is encountered in wetting the sintered titanium particles employing the method of the present invention.

Because the alloy is heated substantially above the infiltration temperature in the method of the present invention, if the mold and its sintered carbide were preheated to the infiltration temperature and held at this infiltration temperature for any appreciable period of time after the alloy was poured, total degredation of the sintered particles would occur. Accordingly, in the method of the present invention the mold and sintered particles must be relatively cool when the alloy is poured, and the poured composite must be allowed to freeze, immediately after the pour. In this manner, the degree of dissolution of the sintered particles is controlled by the pouring temperature of the alloy, the mold temperature, the relative proportions of alloy and sintered carbide, and the surface area of the carbide. As a practical matter the mold must be at least a few hundred degrees below the melting temperature of the sintered carbide binder; i.e., no higher than about 2200° F. when a cobalt binder is employed.

In essence, the method of the present invention distinguishes from previous methods which employed iron, nickel or cobalt based alloys as a matrix material for sintered carbide particles in that the particles placed as inserts in the mold are substantially larger than those desired in the finished composite; the total mass, surface area and position of the particles are controlled to obtain dissolution from the surface of the particles; the matrix material is poured into a mold at a temperature of at least 150° F. above its "penetration temperature" or at least 250° F. above its melting point; and the poured composite is immediately allowed to naturally cool. The resulting composite material distinguishes from previous composites containing sintered carbide particles in an iron alloy matrix or the like in the existence of a relatively large diffusion zone having a high binder metal content and numerous cemented and uncemented metallic carbide particles surrounding the remaining sintered particles to form a wear-resistant but highly resilient shield which will not readily wear away to expose the carbide and strongly resists forces which would tend to tear the particles from the matrix in use.

The composites of the present invention are useful in all of the wear-resistant and security applications. The metallic-carbide particles in the composite are highly drill-resistant and the matrix is substantially more punch-resistant than the softer alloys of the prior art.

The melting temperatures of iron, nickel and cobalt based alloys range between 2400° F. and 3000° F. When these alloys are melted and poured into a cooler mold containing cooler particles the alloy must be heated somewhat above the melting temperature so that it can fill the mold and the interstices between the particles before it is cooled to a freezing temperature. Typically, this "penetration temperature" ranges from at least 100° F. to 400° F. above the melting temperature of the alloy depending on the relative proportions of the alloy and sintered material. When the alloy is poured at this "penetration temperature" very little diffusion of the binder into the alloy occurs because the binder metal has no appreciable solubility in the alloy at the resultant low temperature of the allow after it has infiltrated the particles. For the purposes of the present invention the alloy must be heated above the penetration temperature by a sufficient amount to insure partial dissolving of the binder and resultant degredation of sintered tungsten carbide particles and distribution of the small particles into at least a limited area of the molten alloy. This higher temperature of the melt, which will be hereinafter termed the "diffusion temperature" ranges from at least 50° F. to 300° F. above the penetration temperature or at least 150° above the melting temperature of the alloy.

The upper limits of the "diffusion temperature" are a function of the size of particles or inserts of sintered tungsten carbide placed in the mold and the nature of the quantity of the fine particles dispersed in the mold. If larger particles are employed a greater degree of disintegration may be tolerated without completely destroying the sintered carbide. However, as the degredation of the sintered carbide increases the proportion of available binder metal and carbon in the alloy increases and the upper bound may be set by the degree of brittleness that can be tolerated in the resulting composite. If the finished composite is not likely to be subjected to impact loading a higher degree of diffusion and accordingly a higher alloy temperature can be tolerated.

The "diffusion temperature" which inherently is greater than 2650° F. for the common cobalt bound metallic carbides will vary with the particular matrixing alloy used, the relative proportions of alloy and sintered particles or chunks, and the initial temperature of the mold and its sintered particles at the time of pouring. For example, the required diffusion temperature may be lowered by using a matrixing alloy having a lower melting temperature (but above about 2850° F.) by using relatively large proportions of alloy and small proportions of sintered carbide, by preheating the mold and the carbide, or by a combination of these factors. The determination of the dissolving temperature for a particular combination of these factors can be made by preparing small specimen molds, filling them with the sintered carbide particles to be used, and pouring the molten alloys into the molds at various temperature combinations. Metallurgical examination of the resulting specimens after they have cooled will indicate whether the binder diffused into the alloy matrix to the desired degree. These tests may include cutting, polishing and etching of sections, the preparation of photomicrographs of these sections and performance of hardness and impact tests on the sections using conventional instrumentation.

The resilient diffusion zone around the sintered particles permits even distribution of forces imposed on them to the surrounding matrix. Even if the portion of the zone at the surface of the composite wears away so that the sintered particles stand out from the remaining composite surface and are subjected to larger than usual forces because of this prominence, the strong and resilient wetted region below the surface prevents the particle from being torn out of the composite by these forces.

If the carbide particles are spaced sufficiently close to one another in the mold the diffusion zone will fill the volume between the remaining particles in the composite.

The resulting composites will have an extremely high wear resistance and excellent impact resistance which far surpasses that of previously known composites. When used in such high-wear, high-impact applications as ore or refuse crushing hammers the composites provide several times the life of components formed from conventional materials. By way of example, a hammer for a crushing mill for refuse, formed of a composite of the present invention, had a service life of 3000 tons of refuse as compared to the typical service life of 300 tons for hammers of the same configuration formed of austenitic manganese steel.

The particles used in forming the composites may be homogeneously dispersed about the mold so that the resulting composites have a homogeneous composition. Alternatively, the particles may be positioned in the mold in a heterogeneous manner to form a composite wherein certain sections have the same composition as the poured alloy and other sections contain sintered particles in a local matrixing alloy that is influenced by the diffused components of the sintered material. In this manner the metallurgical characteristics of different sections of the part may be tailored to the functions of those sections. For example, the hammer previously mentioned may be formed with sintered carbide particles adjacent the surfaces that impact the refuse and the sections that connect the hammer to the mill mechanism may be formed of tougher, less brittle metal, or the lock area of a safe door may be covered with a drill resistant plates.

The tungsten carbide particles used with the present invention may range upwardly in size to relatively large sintered sections which may be considered inserts in the final composite part. Typical ranges of the particle sizes, for composites formed in accordance with the present invention: −2 inch/+1 inch; −1 inch/+½ inch; −½ inch/+⅜ inch; −⅜ inch/+50 mesh. Sintered fines of typically −50 mesh to +100 mesh may be employed.

The carbide particles may be randomly distributed in the mold before pouring of the matrixing alloy where the composite to be formed as a homogeneous structure or they may be positioned and mechanically anchored in the manner of inserts when the composite is to have concentrations of sintered particles at particular locations.

The matrix material may be pure iron, nickel or cobalt but will preferably be alloys based upon these metals. The carbon, cobalt and tungsten which diffuse into the molten alloy from the particles during the freezing of the molten alloy in the mold increase the hardness of the resulting alloys in the diffusion zone. The alloy will preferably have at least 70° iron, nickel or cobalt, or a combination of these metals.

Any of the common alloying metals may provide the other constituents, depending upon the application of the composite part.

The composites are preferably poured in sand molds. Relatively large carbide particles or chunks may be positioned in the mold by attaching nails or pins to the chunks and burying the extending ends of these fasteners into the sand. The nails or pins may be attached to the chunks by brazing or cementing.

The nature and object of the invention will be made apparent by the following detailed description of several preferred embodiments of the invention. The description makes reference to the accompanying drawings in which.

EXAMPLE I

Figure 1:
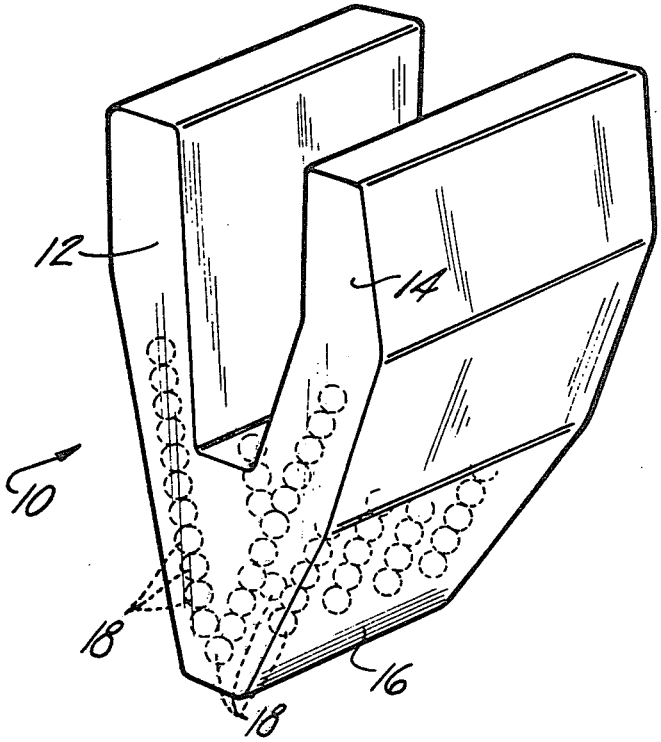
FIG. 1 is a perspective view of a scraper tooth for a bulldozer or the like formed in accordance with the present invention, with sections broken away to illustrate the configuration of the sintered insert.

A scraper tooth for a bulldozer, generally indicated at 10, formed of a composite made in accordance with the present invention, is illustrated in FIG. 1. The tooth 10 consists of a pair of elongated sections 12 and 14, joined at one end to form a hardened cutter tooth 16. The sections 12 and 14 are adapted to join the tooth to the blade of the bulldozer and accordingly must be relatively ductile to avoid their cracking or abrading the mating blade sections. The end and sides of the tooth 16 must be extremely hard so as to resist the abrading forces of rocks and the like and yet must be impact resistant.

The tooth is prepared by forming a female sand mold and lining the edges of the mold along the sections that form the tooth ends 16 with rows of sintered tungsten carbide sections of ball shape. Alternatively, long strips could be used. In the preferred embodiment of the invention the tooth has a total length of about 9 inches and the sections 12 and 14 have the thickness of about 1 inch. The sintered carbide inserts take the form of half-inch diameter balls produced by crushing scrap sintered tungsten carbide cutters and the like in a cage mill. The milling action breaks off the sharp angular edges of the smashed particles to produce substantially rounded shapes. Short nails are attached to the shapes by brazing or cementing the nail heads to the particles and the balls are secured in the sand mold for burying the nails in the sand. The balls are aligned in rows on the mold sides in the approximate positions indicated by the dotted circles 18 on the illustration of the completed part. The sintered tungsten carbide balls preferably have a 12% by weight cobalt binder content. They may have trace elements of titanium or tantalum carbide.

SAE 1010 mild steel is then melted and heated to 3100° F. to 3150° F. in an electric induction furnace. The molten steel is then poured into the mold which may have been heated to about 500° F., and the mass is then allowed to cool immediately in a 70° F. atmosphere. The volume of the molten steel to fill the mold is approximately 4–8 times the volume of the ball inserts. The molten steel readily fills the mold and the interstices between the balls and causes some dissolving of the surface of the balls. The dissolved carbon, cobalt and tungsten diffuse for a substantial distance through the molten steel until the steel freezes.

Analysis of the resulting composite part indicates that approximately 5% of 25% of the volume of the original sintered carbide particles has dissolved and diffused into the steel matrix and that a good metallurgical bond, much stronger than mechanical entrapment, is formed between the remaining sintered particles and the alloyed steel. Upon destructive testing of the sections of the formed tooth in the area of sintered inserts, failure of the structure in the brittle mode may be observed indicating that there is substantial alloying of the carbon, cobalt and tungsten into the mild steel.

Figure 3:
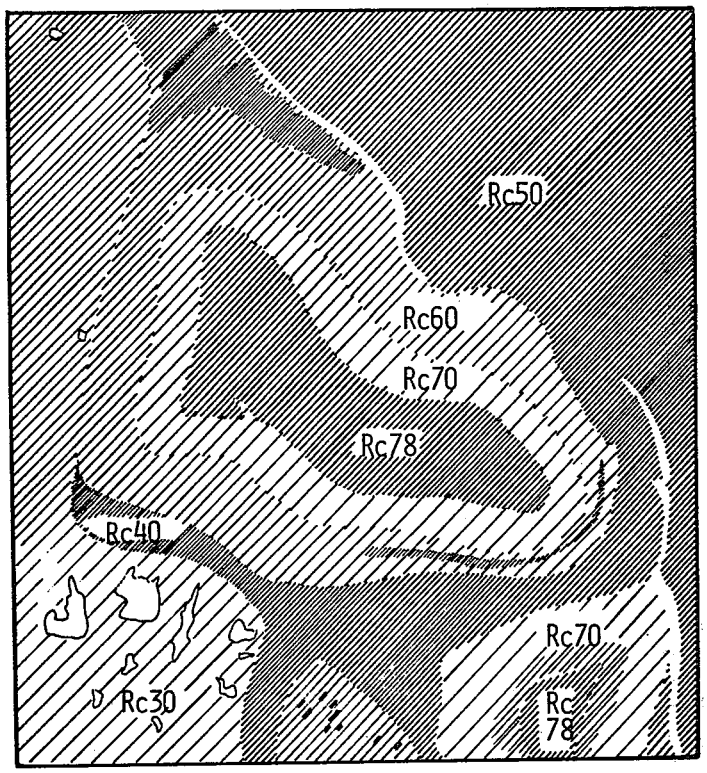
FIG. 3 is a schematic diagram in the nature of a photomicrograph through a sintered tungsten carbide particle in the finished composite illustrating the different metallurgical regions resulting from the diffusion of the sintered material into the alloying matrix.
Figure 4:
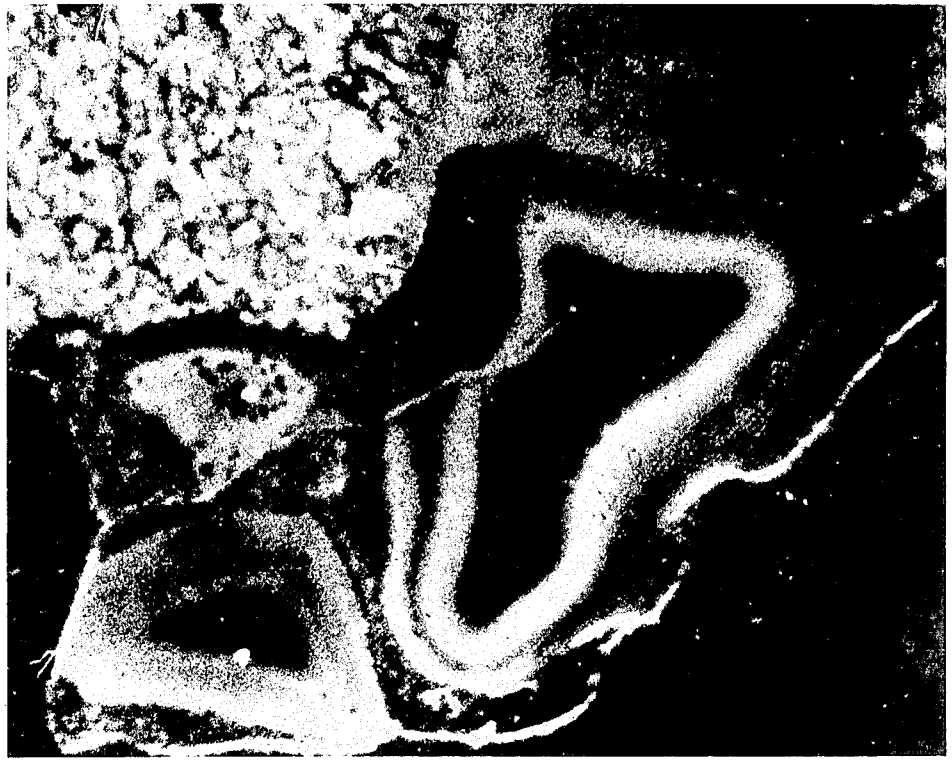
FIG. 4 is an actual photomicrograph of a region similar to that illustrated in FIG. 3.

The resulting composite has characteristics of mild steel at the blade engaging ends and the combined characteristics of the extremely hard sintered tungsten carbide (60–90 Rockwell C) in a matrix of harder but yet resilient steel at the tooth end. As shown in the photomicrographs of FIGS. 3 and 4, which represent a different specimen, a shell of relatively hard resilient materials surround and protect each sintered particle.

EXAMPLE I(a)

The same product was formed using 12% nickel bound sintered tungsten carbide rather than cobalt bound tungsten carbide. The methods and temperatures employed were exactly the same and the metallurgical properties of the resulting composite were substantially the same.

EXAMPLE I(b)

In this test cobalt bound sintered titanium carbide was substituted for the tungsten carbide of Example I. The product was formed in exactly the same manner and the metallurgical properties of the resulting composite were substantially the same as that obtained in Example I.

EXAMPLE II

Figure 2:
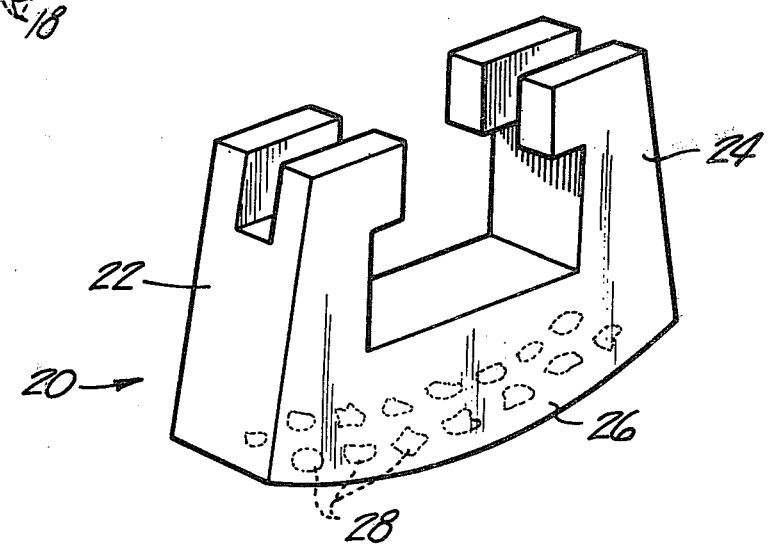
FIG. 2 is a perspective view of a hammer for a hammer mill formed in accordance with the present invention.

A hammer for use in a garbage and refuse crushing hammer mill, formed of a composite made in accordance with the present invention, is illustrated in FIG. 2. The hammer, generally indicated at 20, has a pair of arms 22 and 24 which engage holding mechanisms and a head 26 which acts as the hammer and is subjected to the impact of the refuse or garbage. Angular sintered tungsten carbide chunks were inserted into the sand mold by use of cemented nails in the positions indicated by the dotted line 28 in FIG. 2. The hammer face has an area of 6 inches by 6 inches and the sintered carbide was in the form of ¾ inch and ⅜ inch balls. Scrap steel containing 13% manganese was melted at approximately 3050° F. and 1% manganese was then added to compensate for melting losses. The molten metal was then poured into the mold which was at room temperature. Immediately after the casting operation, the hammers were allowed to cool at room temperature. After cooling they were heat treated by heating them to 1900° F. and holding for ½ hour and then quenching in water.

EXAMPLE III

A hammer having substantially the configuration of the hammer of FIG. 2 was formed by employing manganese steel scrap at a temperature of 3150° F. The steel had the following composition:

Carbon — 1.14%
Manganese — 13.00%
Silicon — 0.73%
Chromium — 0.74%
Nickel — 1.20%
Iron — Balance Approximately 3% by weight of sintered tungsten carbide fines having a range of 4 mesh to 30 mesh was dissolved in the molten steel.

The positions in the mold indicated by the dotted lines 28 in FIG. 2 were then lined with +½ inch −⅜ inch sintered carbide grit and the molten steel with the dissolved fines was poured into the mold at room temperature. The composite mass was immediately allowed to naturally cool.

EXAMPLE IV

A hammer may be formed as in Example III with the fines disposed in the mold rather than in the melt.

FIG. 3 is a schematic diagram representative of a section of composite formed in accordance with the present invention illustrated in the actual photomicrograph of FIG. 4. The photomicrograph represents a composite having one area containing sintered particles in sufficient proximity to one another that the resulting diffusion zones formed a continuous matrix for the particles, and another area of the mold sufficiently devoid of sintered particles so that the character of the composite is essentially that of the poured matrix metal.

The sintered particles remaining in the finished composite have a hardness of Rockwell C 78. The matrix which surrounds them appears to have three regions with hardness of Rockwell C 70, Rockwell C 60 and Rockwell C 40. These areas merge to form a continuous diffusion zone. The basic poured metal is indicated at the lower left and has a hardness of 30 measured on the Rockwell B Scale.

EXAMPLE V

A security test bar was formed by placing 1.75 pounds of 20/30 mesh sintered tungsten carbide particles in a sand mold having a 1 inch by 3 inch by 6 inch mold cavity.

Manganese steel was heated to about 3050° F. and 2.25 pounds were poured into the mold, which was at room temperature. The mold was allowed to naturally cool for one hour and it was then heat treated by heating to 1800° F., holding for one-half hour, and then quenching with water.

The resultant test bar exhibited excellent resistance to attack by drills and punches used in accordance with Underwriters Laboratories standards.

EXAMPLE VI

A security test bar was formed in the same manner as the bar of Example V except that 4/6 mesh sintered tungsten carbide particles were employed in the mold, rather than the finer mesh of Example V. This bar also exhibited excellent security properties.

EXAMPLE VII

A security test bar was formed in the same manner as the bar of Example V except that a carbon mold was employed and was first filled with sintered tungsten carbide grit of −8 to +16 U.S. mesh size. The larger particles were then infiltrated with a mass of smaller particles having a −100 particle size distribution. This infiltration was achieved by placing a layer of the smaller particles over an exposed surface of the larger particles and then vibrating the mold. The infiltration may also be achieved with a manual packing process in which the finer grit is pressed into the interstices in the larger particles. The balance of the process was the same as in Example V.

The ratio between the average size of the large particles and the small particles must be at least 3:1, but is preferably 5:1 or 6:1. This allows the smaller particles to fill the voids formed between the larger particles.

The embodiments of the invention in which an exclusive property or privilege is claimed are defined as follows:

1. The method of forming a metal-metallic carbide composite comprising: supporting a plurality of sintered metallic carbide particles having a mesh size of an average size substantially larger than the sintered metallic-carbide particles desired in the finished composite within a mold; separately heating a metal to melting, to between 2800° F. and 3200° F.; pouring the metal into the mold while the mold and the metallic carbide particles in the mold are at a temperature below about 2200° F. and immediately following the mass to cool and solidify to cause solution of the metallic carbide into the metal from the surfaces of the particles and diffusion of the sintered components to produce a composite having reduced size sintered particles therein surrounded by zones of metal alloyed with components of said sintered particles.

2. The method of claim 1 wherein the metal consists of a steel alloy.

3. The method of claim 1 wherein at least certain of the sintered carbide particles have a mesh size greater than 50.

4. The method of claim 1 wherein the sintered carbide has a cobalt binder containing from 3% to 25% cobalt.

5. The method of claim 1 wherein the mold is maintained in an unheated environment after pouring.

6. The method of claim 1 wherein the particles are heterogeneously dispersed in the mold, whereby a composite is created having first regions wherein the composition of the final composite is substantially identical to the composition of the poured metal, and second regions wherein the composition of the composite is influenced by the infusion of the constituents of the sintered carbide particles.

7. The method of forming a composite material, comprising: supporting a plurality of first particles of sintered metallic carbide of a larger size than the particles desired in the final composite in a mold; maintaining the temperature of the mold and the particles at less than about 2200° F.; heating a metal having at least 70% iron, nickel or cobalt content to at least 200° F. above its melting temperature, separately and above about 2650° F. from the mold; pouring the molten metal into the mold; and immediately allowing the casting thus formed to naturally cool to below the freezing temperature of the composite to produce a composite having reduced size sintered carbide particles therein surrounded by a zone having a high concentration of constituents of the sintered metallic carbide particles.

8. The method of claim 7.wherein the temperature of the molten metal and the relative masses of the sintered metallic carbide and molten metal are such as to prevent the total dissolution of at least certain of the sintered particles in the poured metal before freezing of the composite material.

9. The method of claim 7 wherein the particles of sintered metallic carbide consist of a first group of particles of a first, average size and a second group of particles of a second, average size which is at least three times the average size of the first particles and wherein the particles are placed into the mold by first packing at least a section of the mold with the second particles and then filling the interstices between the sound, large particles with the first, smaller particles.

* * * * *

UNITED STATES PATENT AND TRADEMARK OFFICE

CERTIFICATE OF CORRECTION

PATENT NO. : 4,146,080

DATED : March 27, 1979

INVENTOR(S) : Charles S. Baum

It is certified that error appears in the above-identified patent and that said Letters Patent are hereby corrected as shown below:

Column 5, line 49 "allow" should be --alloy--.

Column 12, line 22 "sound" should be --second--.

Signed and Sealed this

*Seventeenth* Day of *July 1979*

[SEAL]

*Attest:*

*Attesting Officer*

LUTRELLE F. PARKER

*Acting Commissioner of Patents and Trademarks*